US005702168A

United States Patent [19]

Shin

[11] Patent Number: 5,702,168

[45] Date of Patent: Dec. 30, 1997

[54] APPARATUS FOR DAMPING A DOOR OF REFRIGERATOR BEING OPEN AND/OR CLOSED

[75] Inventor: Jun-Chul Shin, Incheon, Rep. of Korea

[73] Assignee: Daewoo Electronics Co., Ltd., Seoul, Rep. of Korea

[21] Appl. No.: 715,242

[22] Filed: Sep. 18, 1996

[30] Foreign Application Priority Data

Sep. 18, 1995 [KR] Rep. of Korea ..... 95-30515

[51] Int. Cl.[6] ..... A47B 96/04

[52] U.S. Cl. ..... 312/405; 312/401; 312/296; 49/383; 49/377.1

[58] Field of Search ..... 312/405, 406, 312/401, 400, 296, 319.1; 49/383, 377.1, 475.1, 478

[56] References Cited

U.S. PATENT DOCUMENTS

| | | | |
|---|---|---|---|
| 2,899,256 | 8/1959 | Kelley | 312/296 |
| 4,063,330 | 12/1977 | Triplette | 49/383 X |
| 4,441,278 | 4/1984 | Covey, III | 49/477.1 |
| 4,640,052 | 2/1987 | Zebedee et al. | 49/383 |
| 4,916,864 | 4/1990 | Thompson | 49/478 |
| 5,129,184 | 7/1992 | Fish | 49/478 |

*Primary Examiner*—Peter M. Cuomo
*Assistant Examiner*—James O. Hansen
*Attorney, Agent, or Firm*—Beveridge, DeGrandi, Weilacher & Young LLP

[57] ABSTRACT

A damping apparatus for a refrigerator has a first space formed in the interior of a cabinet of the refrigerator, a second space which is separated from the first space by a stopping protrusion and is in communication relation with the first space, a first damping member expandably mounted in the second space, and a protrusion formed on one side of a door for closing the first damping member. When the door is pivoted to be closed, the protrusion closes the first damping member so that the air in the interior of the first damping member is exhausted outside, dampening the reactive force generated in a compartment. On the other hand, when the door is pivoted to be opened, the second damping member is pressed so that the force by the negative pressure in the interior of the compartment is dampened. The damping apparatus for a refrigerator can dampen the force needed when the door is opened or closed.

7 Claims, 2 Drawing Sheets

APPARATUS FOR DAMPING A DOOR OF REFRIGERATOR BEING OPEN AND/OR CLOSED

BACKGROUND OF THE INVENTION

1. Field of the Invention

The present invention relates to a refrigerator, and more particularly to a damping apparatus of a refrigerator door.

2. Description of the Prior Art

In general, a refrigerator is an apparatus used in storing various foodstuffs in either a frozen or a refrigerated condition to extend the freshness of the foodstuffs for a long time. A refrigerator generally uses two types of cooling method, i.e., direct and indirect cooling types. In the direct cooling type, direct heat-exchanges are effectively accomplished by installing an evaporator used during the refrigerating cycle in a food storage space. In the indirect cooling type, an evaporator is installed apart from a food storage space. In this cooling type, the air is heat-exchanged by the evaporator, and the heat-exchanged air is introduced into the interior of the food storage space by a fan.

A refrigerator generally has a freezing compartment and a refrigerating compartment located under the freezing compartment. The refrigerating compartment has a main refrigerating compartment, and also has a separated space from the main compartment, which is a vegetable storage area or a chilled compartment. Therefore, the foodstuffs can be selectively stored in accordance with individually desired conditions. Doors are respectively mounted at front portions of the compartments, so that foods can be placed in or removed from the compartments.

The freezing and refrigerating compartments are respectively formed by cabinets, and the doors are pivotally mounted by hinges which are installed on the cabinets. The cabinets and doors are generally made of metal materials. The interiors of the cabinets and doors are filled with insulating materials, which prevents heat-transfer from the outside to the interiors of the compartments. The doors are respectively provided with gasket assemblies instead of any locking devices, for sealing the area between the doors and the compartments when the doors are closed.

Each of the gasket assemblies includes a gasket for sealing the area between a cabinet and a door when the door is closed, and a magnetic strip for keeping the door closely attached to the compartment. Namely, each of the doors is closely attached to each of the cabinets by a magnetic strip, sealing the area between the door and the compartment.

The above-mentioned gaskets are disclosed in U.S. Pat. No. 4,916,864 (issued to Thomson on Apr. 17, 1990), U.S. Pat. No. 5,129,184 (issued to Fish on Jul. 14, 1992), and U.S. Pat. No. 5,309,680 (issued to Kiel on May 10, 1994).

In a refrigerator, the air in a refrigerating compartment or a freezing compartment flows through the area between a door and the compartments while the door is pivoted. Thus, the air-flow causes a reacting force. The reacting force caused by the air-flow can be reduced by closing the door slowly, thereby reducing the flow-rate of the air between the door and the compartments. Also, the reacting force can be overcome by closing the door quickly.

Nevertheless, if the door is closed slowly, the cooling efficiency of the refrigerator is lowered by the heat-transfer to the interior of the compartments from outside.

On the other hand, if the door is closed quickly, it tends to be stopped ajar due to the repulsive force of the impact so that a gap between the door and the body of the refrigerator is formed. When the door is ajar, the cooling efficiency of the refrigerator is also lowered by the heat-transfer through the gap to the interior of the compartments from outside.

In order to prevent the door from being ajar, a gasket assembly using a magnet having a strong magnetic force is used. Nevertheless, a refrigerator using a magnet having a strong magnetic force has a disadvantage in that a strong force is needed by a user to open the door. Further, the refrigerator has another disadvantage in that it tends to be shaken while the door is being opened due to the strong force.

SUMMARY OF THE INVENTION

Therefore, it is an object of the present invention to provide a damping apparatus for a refrigerator which can reduce the reacting force needed when a refrigerator door is opened or closed, so that the door can be opened with a weak force.

To achieve the object of the present invention, there is provided a damping apparatus for a refrigerator comprising:

a cabinet having side walls, a base plate, an upper plate, and a rear plate so as to form at least one compartment, the front of which is open, wherein the interior of the cabinet is filled with an insulating material, first and second spaces are formed in the interior of one of the side walls, a stopping protrusion is formed between the first and second spaces, and a slit which extends from the inner surface of the second space to the front surface of the side wall is formed so that the first and second spaces are in communicating relation with each other;

a door pivotally mounted on the cabinet so as to be closed or opened, wherein a protrusion for closing the first space is formed; and damping means which is slidably and expandably mounted so as to dampen the reactive force generated by the air between the compartments and the door when the door is opened and so as to dampen the negative pressure generated by the cooling of the air in the compartments when the door is opened.

The damping means comprises a first damping member slidably mounted in the first space, wherein both ends thereof are open, one end thereof is closed when the protrusion of the door is closed, an exhausting protrusion which slides in the first space and which is stopped by the stopping protrusion is formed, and a first exhausting hole for exhausting the air of the interior thereof is formed in the exhausting protrusion; a second damping member slidably mounted in the second space and connected to the other end of the first damping member, wherein a second exhausting hole for exhausting the air in the interior thereof is formed.

When the door is closed so that the protrusion of the door closes one end of the first damping member, the first damping member is moved to the inside of one of the side walls, and the air in the first damping member inflates the second damping member. As the second damping member is inflated, the air in the second damping member is exhausted outside the second damping member through a hole formed therein. Some of the air exhausted outside the second damping member is exhausted through a first orifice, a buffer space, and a second orifice, and the rest of the air is exhausted through the slit.

Since the diameters of the first and second orifices are very small as compared with the first and buffer spaces, the air in the first and second damping members is exhausted outside the refrigerator slowly, so that, even the door is pivoted to be closed quickly, the reactive force of an impact of the door can be effectively reduced.

Further, when the door is pivoted to be opened, air is introduced into the buffer space from outside the refrigerator. The air is then introduced into the interior of the second space and pushes the second damping member towards the front of the refrigerator, so that the door can be opened easily.

BRIEF DESCRIPTION OF THE DRAWINGS

The above objects and other advantages of the present invention will become more apparent by describing in detail a preferred embodiment thereof with reference to the attached drawings, in which.

DETAILED DESCRIPTION OF THE PREFERRED EMBODIMENT

Hereinafter, a preferred embodiment of the present invention will be described in detail with reference to the accompanying drawings.

Figure 1:
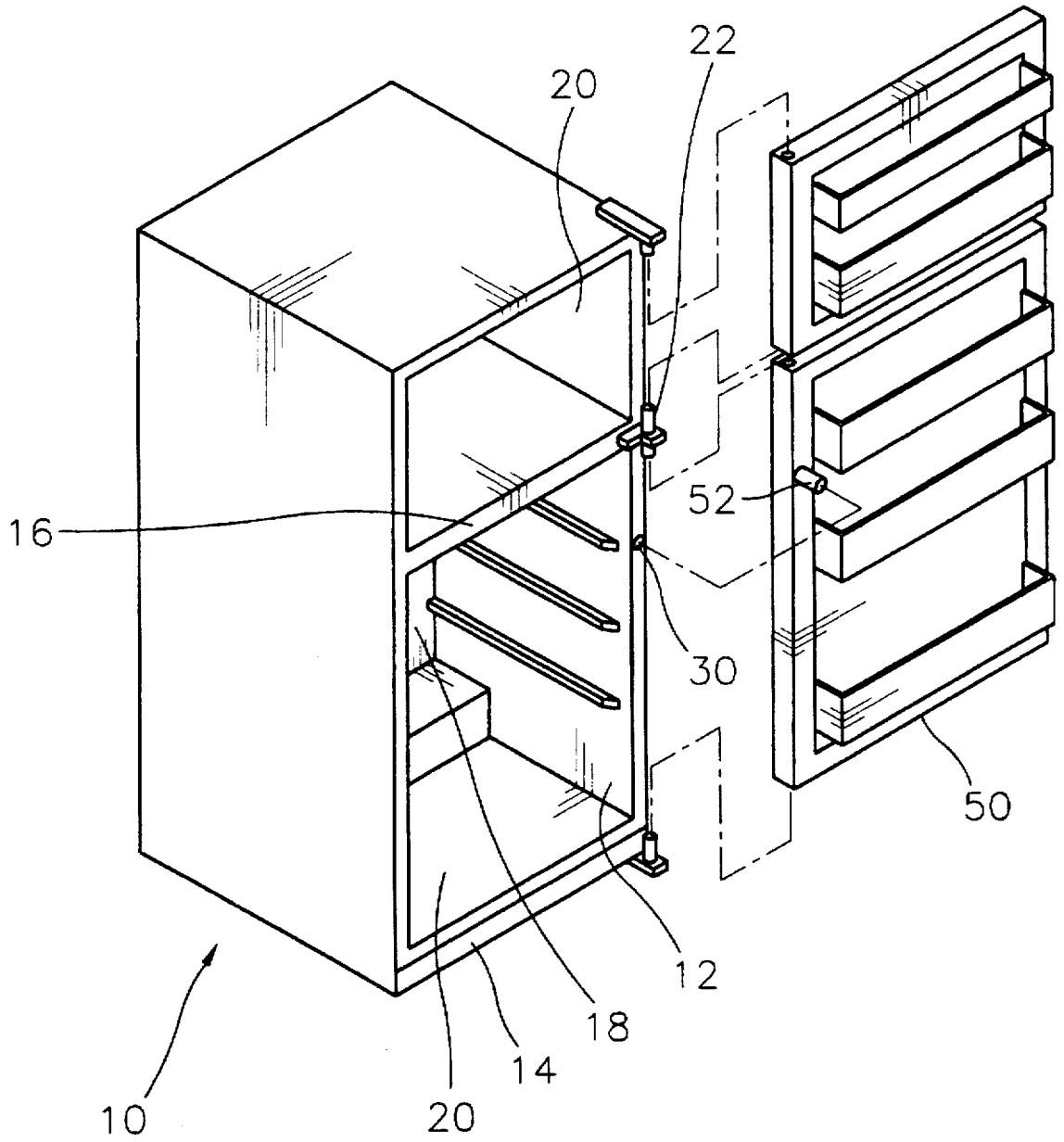
FIG. 1 is a view for showing a refrigerator on which a damping apparatus according to the present invention is mounted.
Figure 2:
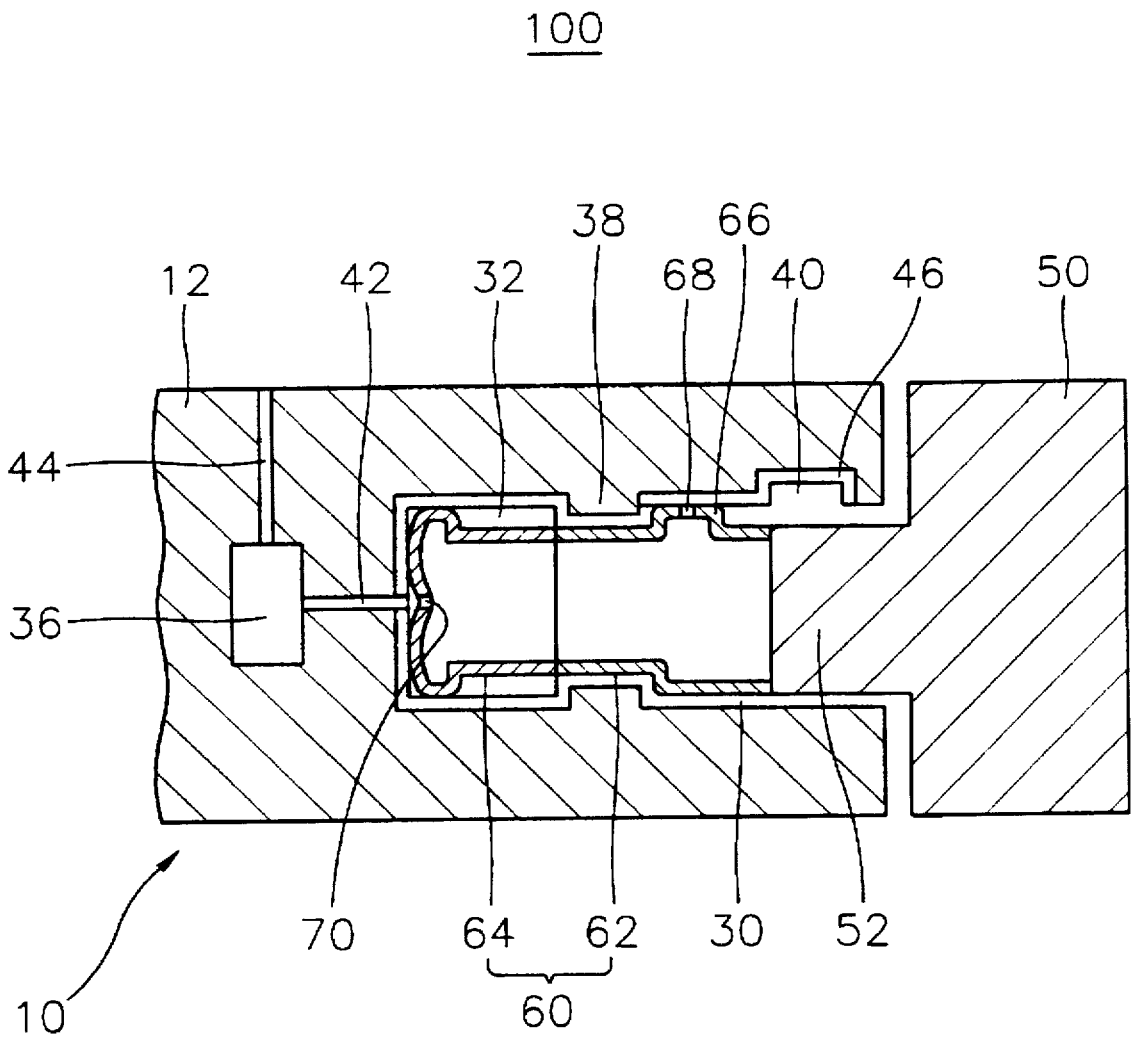
FIG. 2 is a cross sectional view for showing the damping apparatus which is mounted in a side wall of the refrigerator of FIG. 1.

FIG. 1 shows the location of a damping apparatus according to one preferred embodiment of the present invention mounted on a refrigerator. FIG. 2 is a cross sectional view for showing the damping apparatus which is mounted in a side wall of the refrigerator of FIG. 1.

With reference to FIGS. 1 and 2, a damping apparatus 100 according to a preferred embodiment of the present invention comprises a cabinet 10 having two side walls 12, a base plate 14, an upper plate 16, and a rear plate 18, a door 50, and a damper.

Cabinet 10 forms at least one compartment 20 whose front is open, by side walls 12, base plate 14, upper plate 16, and rear wall 18. The interior of cabinet 10 is filled with an insulating material for minimizing the heat-transfer to the compartments from outside. Installed on base plate 14 and upper plate 16 are hinges 22 by which doors 50 are also mounted.

A first space 30, a second space 32, and a buffer space 36 are formed in the interior of side walls 12. First and second spaces 30 and 32 are separated from each other by a stopping protrusion 38 which protrudes between first and second spaces 30 and 32. An exhausting recess 40 is formed in first space 30. Buffer space 36 is communicated with second space 34 through first orifice 42. A first orifice 42 is formed between second space 34 and buffer space 36, so that buffer space 36 is in air-flow communicating relation with second space 34 through first orifice 42. Buffer space 36 is communicated with the outside of the refrigerator through second orifice 44. Thus, the air in buffer space 36 may flow to or from the outside of the refrigerator by second orifice 44. A slit 46 which extends from one end of first orifice 42 to exhausting recess 40 formed at first space 30, is formed.

Installed in the front of attaching door 50 is a gasket assembly (not shown) for closing attaching door 50 to a cabinet 10, thereby sealing a compartment 20. A protrusion 52 is formed on one side of the front of door 50.

Damper 60 is slidably and expandably mounted in first and second spaces 30 and 32. Damper 60 dampens the reacting force generated when door 50 is closed. Damper 60 also dampens the force due to a negative pressure which is generated by the cooling air in compartment 20 when door 50 is opened.

Damper 60 comprises a first damping member 62 having two opened ends, one end of which is opened and closed by protrusion 52 of the gasket assembly, and a second damping member 64 which is expandably installed in second space 34 and connected to the other end of first damping member 62.

First damping member 62 comprises a synthetic resin. An exhausting protrusion 66 is formed on one side of first damping member 62, and an exhausting hole 68 is formed at exhausting protrusion 66. The side walls of first damping member 62 slide on stopping protrusion 38, and exhausting protrusion 66 slides along slit 46. The slide of first damping member 62 into second space 34 is stopped as exhausting protrusion 66 is stopped by stopping protrusion 38.

When door 50 is pivoted to close compartment 20, the air is introduced into the interior of first damping member 62. Most of the air flows into the interior of second damping member 64, the rest is exhausted through exhausting hole 68. Second damping member 64 is a bag comprised of an elastic material, one end of which is connected to one end of first damping member 62. A second exhausting hole 70 is formed at second damping member 64. The air introduced into the interior of second damping member 64 through first damping member 62 is exhausted outside through second exhausting hole 70.

On the other hand, a negative pressure is formed in first and second members 62 and 64 by protrusion 52 of the gasket assembly when door 50 is pivoted to open compartment 20. Then, when protrusion 52 of the gasket assembly is moved backward, first damping member 62 is also moved together with protrusion 52. The air outside the refrigerator is introduced into first and second spaces 32 and 34 through two passages by the movement of first damping member 62. One of the passages is provided by exhausting recess 40, and the other by second orifice 44, buffer space 36, and first orifice 42.

Hereinafter, the operation of a damping apparatus of a refrigerator according to the present invention will be explained.

As door 50 is pivoted so that compartment 20 is opened, exhausting protrusion 66 of first damping member 62 is located adjacent to exhausting recess 40, and then second damping member 64 is shrunk. At this time, if door 50 is further pivoted so that protrusion 52 of the gasket assembly is moved to one end of first damping member 62, some air is introduced into the interior of first damping member 62 and second damping member 64 is inflated. Some of the air introduced into first damping member 62 is exhausted through first exhausting hole 68 of exhausting protrusion 38, and exhausting recess 40. Protrusion 52 of the gasket assembly is moved further so as to close first damping member 62, first damping member 62 slides into first space 30 through protrusion 52 and exhausting protrusion 38 is moved away from exhausting recess 40. At the same time, some of the air in first space 30 is exhausted outside through first exhausting hole 68 and slit 46. If first damping member 62 continues to be moved, some of the air in second damping member 64 is exhausted through second exhausting hole 70, first orifice 42, buffer space 36, and second orifice 44, and the rest of the air is exhausted through second exhausting hole 70, slit 46, and exhausting recess 40.

Therefore, in the refrigerator according to the present invention, when door 50 is pivoted so as to be closed, since the air in the interior of first and second damping members 62 and 64 is exhausted outside, the reactive force in compartment 20 generated by the closing of door 50 can be effectively dampened.

On the other hand, a negative pressure is formed in first and second members 62 and 64 by protrusion 52 of the gasket assembly when door 50 is opened. The negative pressure causes first and second damping members 60 and 62 to slide into first space 30. Then, since second damping member 62 is compressed, the air from outside is introduced both into the interior of first damping member 60 through exhausting recess 40, slit 46, and first exhausting hole 72 and into the interior of second damping member 62 through second orifice 44, buffer space 36, first orifice 42, and first exhausting hole 72. The air introduced into first and second damping members 60 and 62 provides positive pressure to protrusion 52 of the gasket assembly, and then protrusion 52 of the gasket assembly is moved backward faster. When protrusion 52 is moved further backward, the air introduced into first damping member 60 through exhausting recess 40, slit 46, and first exhausting hole 68 in introduced into the interior of first damping member 30 through exhausting recess 40 and first exhausting hole 68. Then, since the amount of the air introduced through recess 40 and first exhausting hole 68 is more than the amount of the air introduced into the interior of first damping member 60 through exhausting recess 40, slit 46, and first exhausting hole 68, protrusion 52 of the gasket assembly is moved backward faster.

The introduction of the air into first and second damping member 30 and 32 by the backward movement of protrusion 52 of the gasket assembly causes the negative pressure in compartment 20 to be dampened, so that door 50 can be opened more easily.

While the present invention has been particularly shown and described with reference to a particular embodiment thereof, it will be understood by those skilled in the art that various changes in form and details may be affected therein without departing from the spirit and scope of the invention as defined by the appended claims.

What is claimed is:

1. A damping apparatus for a refrigerator comprising:

a cabinet having side walls, a base plate, an upper plate, and a rear plate so as to form at least one compartment, a front of which is open, wherein an interior of said cabinet is filled with an insulating material, first and second spaces are formed in the interior of one of the side walls, a stopping protrusion is formed between the first and second spaces, and a slit which extends from an inner surface of the second space to a front surface of the side wall is formed so that the first and second space are in communicating relation with each other;

a door pivotally mounted on said cabinet so as to be closed or opened, wherein a protrusion for closing the first space is formed; and damping means which is slidably and expandably mounted so as to dampen a reactive force generated by air between the compartment and said door when said door is opened and so as to dampen a negative pressure generated by the cooling of air in the compartment when said door is opened, wherein said damping means comprises a first damping member slidably mounted in the first space, wherein both ends thereof are open, a first end thereof is closed when the protrusion of said door is closed, an exhausting protrusion which slides in the first space and which is stopped by the stopping protrusion is formed and a first exhausting hole for exhausting the air of the interior thereof is formed in the exhausting protrusion, and a second damping member slidably mounted in the second space and connected to a second end of the first damping member, wherein a second exhausting hole for exhausting the air in the interior thereof is formed.

2. A damping apparatus according to claim 1, wherein the first damping member is comprised of a synthetic resin.

3. A damping apparatus according to claim 1, wherein the second damping member is comprised of rubber.

4. A damping apparatus according to claim 1, wherein a buffer space which provides a space for exhausting an interior of the second space is formed in one of the side walls, a first orifice is formed so that the buffer space is in communicating relation with the second space by the first orifice, and a second orifice is formed so that the buffer space is in communicating relation with the outside of the refrigerator through the second orifice, and wherein said damping means comprises a first damping member slidably mounted in the first space, wherein both ends thereof are open, a first end thereof is closed when the protrusion of said door is closed, an exhausting protrusion which slides in the first space and which is stopped by the stopping protrusion is formed, and a first exhausting hole for exhausting the air of the interior thereof is formed in the exhausting protrusion; a second damping member slidably mounted in the second space and connected to a second end of the first damping member, wherein a second exhausting hole for exhausting the air in the interior thereof is formed.

5. A damping apparatus according to claim 4, wherein the first damping member is comprised of a synthetic resin.

6. A damping apparatus according to claim 4, wherein the second damping member is comprised of rubber.

7. A damping apparatus for a refrigerator comprising:

a cabinet having side walls, a base plate, an upper plate, and a rear plate so as to form at least one compartment, the front of which is open, wherein an interior of said cabinet is filled with an insulating material, first and second spaces are formed in the interior of one of the side walls, a stopping protrusion is formed between the first and second spaces, a buffer space which provides a space for exhausting an interior of the second space is formed in one of the side walls, a first orifice is formed so that the buffer space is in communicating relation with the second space by the first orifice, a second orifice is formed so that the buffer space is in communicating relation with the outside of the refrigerator through the second orifice, and a slit which extends from an inner surface of the second space to a front surface of the side wall is formed so that the first and second spaces are in communicating relation with each other;

a door pivotally mounted on said cabinet so as to be closed or opened, wherein a protrusion for closing the first space is formed;

damping means which is slidably and expandably mounted so as to dampen the reactive force generated by air between the compartment and said door when said door is opened and so as to dampen the negative pressure generated by the cooling of the air in the compartment when said door is opened, the damping means comprising a first damping member slidably mounted in the first space, wherein both ends thereof are open, a first end thereof is closed when the protrusion of said door is closed, an exhausting protrusion which slides in the first space and which is stopped by the stopping protrusion is formed, and a first exhausting hole for exhausting the air of the interior thereof is formed in the exhausting protrusion; a second damping member slidably mounted in the second space and connected to a second end of the first damping member, wherein a second exhausting hole for exhausting the air in the interior thereof is formed.

* * * * *